US005298836A

United States Patent [19]

Backmund et al.

[11] Patent Number: 5,298,836

[45] Date of Patent: Mar. 29, 1994

[54] POWER SUPPLY CIRCUIT FOR GAS DISCHARGE LAMPS OPERATING AT A RESONANT FREQUENCY

[75] Inventors: Peter Backmund, Nuremberg; Gottfried Stockinger, Eckental; Helmut Losel, Neunkirchen, all of Fed. Rep. of Germany

[73] Assignee: Diehl GmbH & Co., Fed. Rep. of Germany

[21] Appl. No.: 928,799

[22] Filed: Aug. 12, 1992

[30] Foreign Application Priority Data

Aug. 27, 1991 [DE] Fed. Rep. of Germany ..... 4128314

[51] Int. Cl.[5] ..... H05B 37/02

[52] U.S. Cl. ..... 315/219; 315/209 R; 315/98; 315/307; 315/DIG. 7

[58] Field of Search ..... 315/219, DIG. 7, 98, 315/307, 209

[56] References Cited

U.S. PATENT DOCUMENTS 3,746,919 7/1973 Laupman ..... 315/105
4,523,131 6/1985 Zansky ..... 315/219 X

FOREIGN PATENT DOCUMENTS 0374617 6/1990 European Pat. Off. .
2512918 10/1975 Fed. Rep. of Germany .
3327189 2/1985 Fed. Rep. of Germany .
3733263 4/1988 Fed. Rep. of Germany .
4005776 9/1990 Fed. Rep. of Germany .

*Primary Examiner*—Robert J. Pascal
*Assistant Examiner*—R. A. Ratliff
*Attorney, Agent, or Firm*—Scully, Scott, Murphy & Presser

[57] ABSTRACT

A power supply circuit for any kind of loads or power consuming devices which are connected to an electrical power supply; especially lamps, such as at least one glow or gas discharge lamp, wherein a pulse width modulator controls electronic switches of a push-pull oscillator, and wherein the pulse frequency of the pulse width modulator is tuned to the resonant frequency of a resonant transformer of the push-pull oscillator which has the secondary side thereof connected to the gas discharge lamp. A control circuit monitors a current and/or voltage value and/or time value which is characteristic for the presence of the resonance and which, upon a change in the resonant frequency, will change the pulse frequency of the pulse width modulator to ensure operation at the new resonant frequency.

13 Claims, 4 Drawing Sheets

FIG. 4
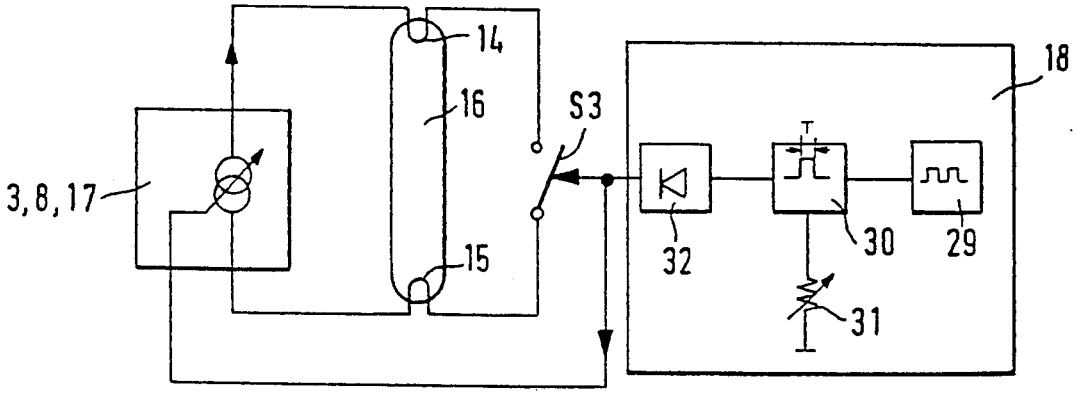
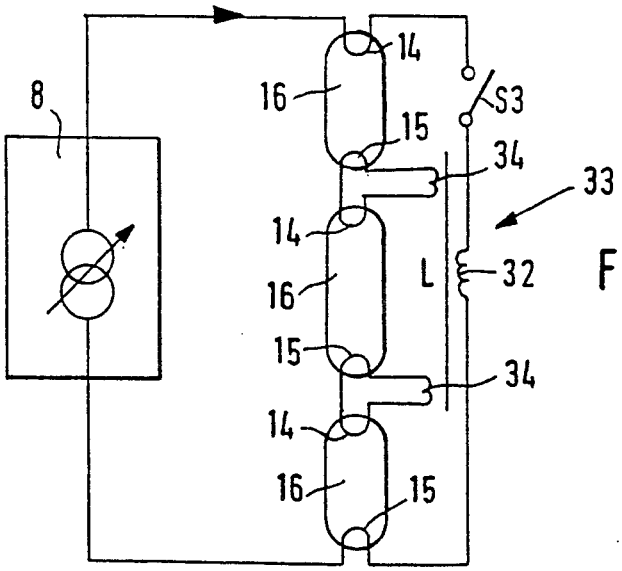
FIG. 5

POWER SUPPLY CIRCUIT FOR GAS DISCHARGE LAMPS OPERATING AT A RESONANT FREQUENCY

BACKGROUND OF THE INVENTION

1. Field of the Invention

The present invention relates to a power supply circuit for any kind of loads or power consuming devices which are connected to an electrical power supply; especially lamps, such as at least one glow or gas discharge lamp, wherein a pulse width modulator controls electronic switches of a push-pull oscillator, and wherein the pulse frequency of the pulse width modulator is tuned to the resonant frequency of a resonance transmitter of the push-pull oscillator which has the secondary side thereof connected to the gas discharge lamp.

2. Discussion of the Prior Art

A power supply circuit of that type for a gas discharge lamp is described in the specification of German Laid-Open Patent Appln. 40 05 776 A1. In order to be able to attain a high degree of efficiency, the frequency of the current flowing through the lamp is adjusted by the pulse frequency of the pulse width modulator to the resonant frequency of an oscillating circuit of the resonance transformer. Hereby, the resonance frequency is independent of that of the power supply.

The pulse frequency of the pulse width modulator is thusly tuned or adapted through the intermediary of a variable impedance or resistance to the resonance frequency of an oscillating circuit formed from the secondary winding of the resonance transformer, a capacitance and the lamp. However, when the resonance frequency changes, there is then encountered a mistuning which places into question the attainment of the desired high degree of operating efficiency. Such a change in the resonance frequency can be encountered, for example, through the ageing of the components or in response to temperature changes. Moreover, in the utilization of different gas discharge lamps possessing differing resonance frequencies, it is possible that in German 40 05 776 A1, in every individual instance there would be required a correlation of the pulse frequency of the pulse width modulator to the current resonance frequency.

In the disclosure of German 40 05 776 A1 there is proposed that for the dimming of the gas discharge lamp, there is correspondingly adjusted or set the keying ratio of the pulse width modulator.

In the disclosure of German 40 05 776 A1, by means of a transistor of a rectifying bridge there can be controlled the preheating of the electrodes of the gas discharge lamp.

Circuit arrangements in which the gas discharge lamp are operated at the frequency of an alternating current power supply are set forth in the disclosures of German Patent Publications 33 27 189 A1 and 25 12 918 B2. In those instances, it is not contemplated to connect the gas discharge lamps to a direct-current voltage supply, or to operate the gas discharge lamps at a frequency which is higher than the frequency of the alternating-current power supply which powers the lamps.

SUMMARY OF THE INVENTION

Accordingly, it is an object of the present invention to improve upon a circuit arrangement of the above-mentioned type, especially with respect to the efficiency in the light output, the quality of the illumination, the lifetime of the lamps, the level of emission of radio frequency energy, and the flexibility of the design for various applications.

Inventively, the above-mentioned object is attained in a current supply circuit of the above-described type, in that there is contemplated the provision of a control circuit which determines a current and/or voltage value and/or time value which is characteristic for the detection of the resonant frequency and which, upon a change in the resonance frequency, will tune the pulse frequency of the pulse width modulator for the changed resonant frequency.

As a consequence, there is resultingly achieved that the frequency of the operating current for the lamp will also be always at the resonance frequency which is dependent upon the lamp. This provides for a higher degree of operating efficiency. An efficiently high light output is obtained through the selection of a correspondingly high resonance frequency ($\geqq$100 kHz). The resonant operation is also maintained when the resonance frequency changes; for example, due to differing lamps, or the change in characteristics due to lamp ageing. In view of the constant amplitude of the voltage of the resonant circuit in the instance of resonance, there is also obtained a high quality of light which is free of any flickering.

Through a setting of the duty cycle for the pulse width modulator, the current amplitude of the lamp current is regulated in such a manner that even upon the occurrence of a normal input voltage variation, there is maintained a constant brightness for the lamp.

A dimming of the lamp can be carried out through a periodic short-circuiting of the lamp filaments whereby, as a rule, the frequency of this short-circuiting is substantially lower than the resonant frequency. The lamp is hereby always operated at its rated lighting current, which increases the service life thereof. When the filaments are short-circuited, the heating current voltage flows through the cathodes of the lamp. The heating current and the operating current can differ in conformance with the connecting data for the lamp.

BRIEF DESCRIPTION OF THE DRAWINGS

Advantageous features and aspects of the invention may now be more readily ascertained from the following detailed description of exemplary embodiment thereof, taken in conjunction with the accompanying drawings; in which:

FIG. 4 illustrates a block circuit diagram of a brightness control for FIG. 1;

FIG. 5 illustrates the circuit of interconnecting a plurality of gas discharge lamps to the ballast unit of FIG. 1.

DETAILED DESCRIPTION

Figure 1:
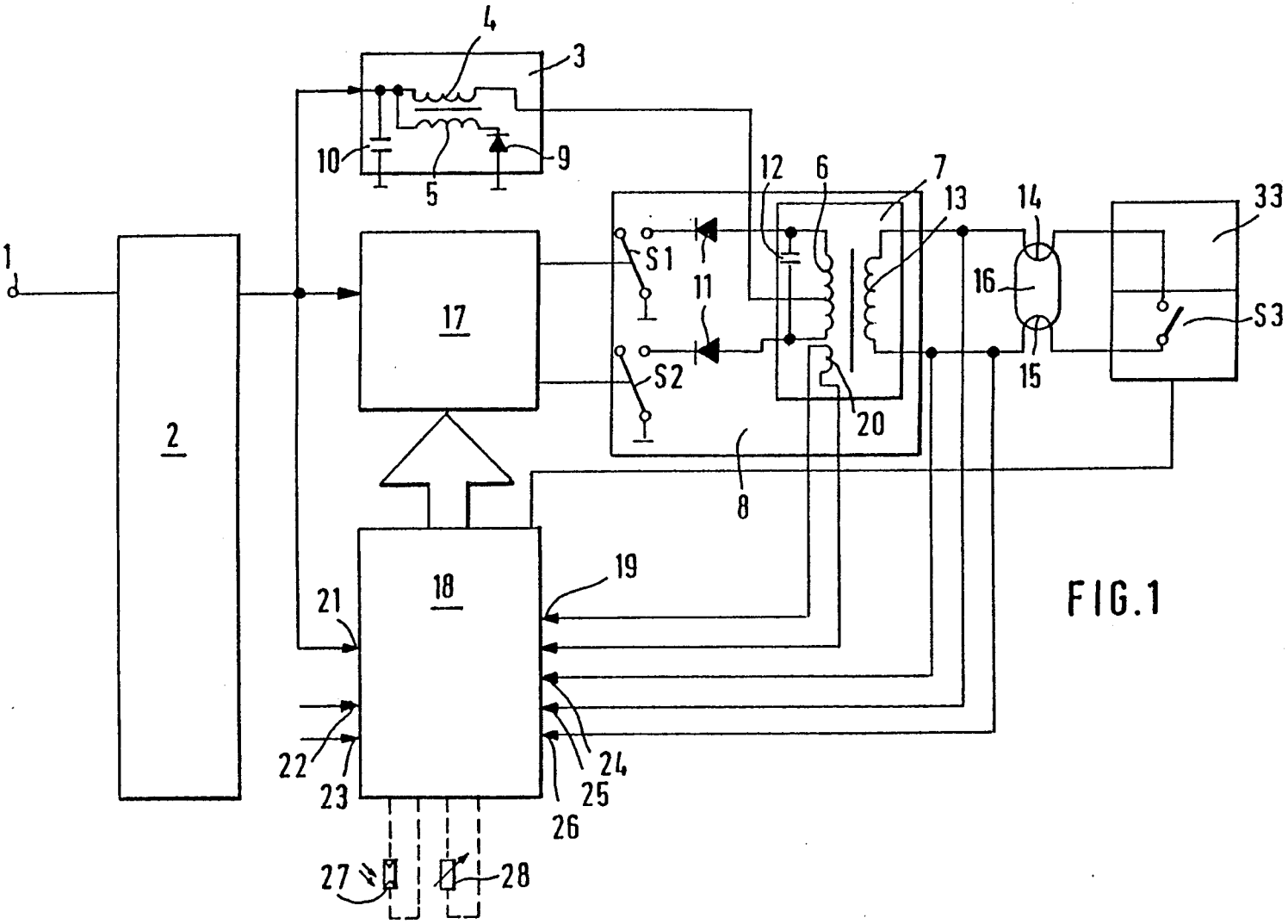
FIG. 1 illustrates a block circuit diagram of a power supply circuit or; in essence, a ballast unit for a gas discharge lamp.

Connected to a direct-current supply voltage input 1 is a filter 2. The direct-current supply voltage; for example, originates from the power supply on board an aircraft or an electric train. The direct-current supply voltage can also be derived or obtained across an AC/DC-converter from an alternating-current voltage supply; for instance, that on board an aircraft.

The filter 2 protects the circuit from power surges and for dropouts in the power supply and reduces conducted radio frequency emission to the required specification limits. Connected to the output of the filter 2 is an input transformer 3 which possesses a first winding 4 and a second winding 5. The first winding 4 is connected in series with a center tap on a primary winding 6 of an output transformer 7 which is integrated in a push-pull oscillator 8.

The second winding 5 of the input transformer 3 is connected as a free wheeling relaxation winding across a diode 9 to the supply voltage. Connected in parallel therewith is a capacitor 10. The transformer 3 is adapted to achieve a constant current flow in the output transmitter or transformer 7. Through a reduction in the duty cycle for the switches S1, S2, this leads to time intervals during which no current flow is possible through the output transformer 7. During these time intervals, the winding 5 acts as a bypass or free wheeling winding. As a result thereof, there are attenuated any inductive switching transients.

The push-pull oscillator 8 operates with electronic switches S1, S2 which are located across diodes 11 at presently one end of the primary winding 6. Connected in parallel with the primary winding 6 is an resonant capacitance 12 which is formed by a capacitor. The electronic switches S1, S2 are constructed; for example, from transistors. It is also possible to connect the resonant capacitor 12 between the ends of the primary winding 6 and to connect the switches S1, S2 to center taps on the primary winding 6.

Connected to a secondary winding 13 of the output transformer 7 are the filaments 14, 15 of a lamp 16. The latter; for example, can consist of a gas discharge lamp, a halogen lamp, flashlight lamp or a mercury vapor lamp. Moreover, a plurality of such kinds of lamps can also be connected to the secondary winding 13. FIG. 5 illustrates the series circuit formed from three gas discharge lamps.

The switches S1, S2 are controlled by a pulse width modulator 17, whose pulse frequency and whose duty cycle are adjustable. For effectuating the adjustment or setting of the pulse frequency and the keying ratio there is provided a control circuit 18.

In the push-pull oscillator 8, the resonant capacitance 12 on the primary side of the transformer along with the impedance of the primary winding 6 and the reflected complex impedance of the lamp 16 determines the resonant frequency of the circuitry, consequently the characteristics of the lamp 16 will have an effect on the resonant frequency of the circuitry. It is an aim that the pulse frequency of the pulse width modulator 17 is identical to the resonant frequency, so that the frequency of the current on the primary side is identical to the frequency of the current on the secondary side of the output transformer 7 lies at the resonance frequency. For example, the frequency is approximately at 100 kHz. In effect, the frequency lies essentially much higher than the frequency of an alternating-current power source which is provided for the lamp 16, which, for instance, in the case of an aircraft, has a frequency of 400 Hz.

The control circuit 18 at input 19 thereof determines as to whether the oscillating circuit which is constituted from the capacitance 12, the primary winding 6 and the reflected load formed by the lamp 16, oscillate in resonance. For this purpose, according to FIG. 1, a control winding 20 is provided on the output transformer 7, at which there is present an applicable signal form in the case of resonance.

The control circuit 18 regulates the frequency of the pulse width modulator 17 in such a manner, that the switches the switches S1, S2 are controlled at the resonant frequency. As a result, this will afford that in the output transformer 7 there will be attained sinusoidal waveforms with a low distortion factor. Hereby, there are obtained low switching losses, low core losses and minimal emission of radio frequency energy.

By means of the control circuit 18, it is also possible to adjust or set the duty cycle of the pulse width modulator 17. Through the setting of the duty cycle, the output current of the output transformer 7 can be controlled; in effect, the operating current or, respectively the heating current for the gas discharge lamp 16. For this purpose, the control circuit 18 possesses a few additional inputs.

The control circuit 18 monitors the input voltage at an input 21. The control circuit 18 readjusts the duty cycle in the presence of a fluctuating input voltage in such a manner, that there is achieved a constant brightness.

Connected at a further input 22 is a control element; for instance, the switch S3, through the duty cycle of which a dimming in the brightness of the lamp 16 is permitted.

A further input 23 of the control circuit 18 serves for the on-and-off switching of the lamp 16.

At further inputs 24, 25, 26 there are determined the voltages which are present at the heating filaments 14, 16; or in essence, the lamp current. Upon an exceeding or falling below of threshold values in the case of disturbances, the lamp 16 is switched off.

The control circuit 18 can have a brightness sensor 27 and/or a temperature sensor 28 connected thereto. By means of the brightness sensor 27 there is determined the brightness in the illumination of the lamp 16, through the control of the duty cycle of the pulse width modulator 17 readjusted to a rated value. By means of the temperature sensor 28 the ambient temperature of the lamp 16 is monitored. In connection with the known temperature function of the output of light for the lamp 16, the brightness can be maintained substantially constant independently of the ambient temperature. At a suitable temperature, there is effected a switching over from the heating current to the operating current.

During the operation of the pulse width modulator 17 which is controlled by the control circuit 18, in accordance with the duty cycle there is a minimum deadtime period. Hereby, the transformer 3 produces a free wheel for the induction voltage which is encountered at the primary winding 6. The transformer 3 also ensures a constant flow of current to the output transformer 7.

Connected in series with the filaments 14, 15 is an electronic switch S3. This switch is closed in the usual manner for the heating of the electrodes 14, 15. The switch S3 is controlled by the control circuit 18. During dimmed operation, the switch is periodically opened and closed; preferably, over presently a plurality of sinusoidal waves of the push-pull oscillator 8.

In FIG. 4 there is more closely elucidated the control circuit 18 to the extent in which it controls or activates the switch S3. The modules or subassemblies 3, 8, and 17 are represented as an adjustable constant-current source, which they form in principle. The control circuit 18 possesses a square-wave oscillator 29 operating at a frequency; for example, of 100 Hz. Connected to the output of the latter is a monostable multivibrator 30 whose duration of pulses is adjustable through a variable resistor 31. The monostable multivibrator 30 switches the switch S3 and the constant-current source, especially the pulse width modulator 17 through an amplifier 32. As a result thereof, there can also be set a heating current which differs from the lamp current. In dependence upon the duty cycle of the monostable multivibrator 30 there is dimmed, the lamp 16. This duty cycle is independent of the frequency which is supplied to the gas discharge lamp 16 by the push-pull oscillator 8. Consequently, it is not absolutely necessary to provide a synchronization between the frequency of the oscillator 29 and the frequency of the push-pull oscillator 8. If required, or synchronization can be implemented through the monitoring of the zero-crossing of the current or voltage of the current or voltage for the frequency of the push-pull oscillator 8. The frequency of the oscillator 29 is preferably selected such that the fluctuations in the brightness which result from the actuation of the switch S3 cannot be ascertained by the human eye. The frequency of the oscillator 29 which lies above the visible limit or threshold of visibility; for example, 100 Hz, affords a non-flickering operation even during dimming.

During dimming, while no lamp current flows through the gas discharge lamp, a heating current will flow. The effective value thereof is hereby the greater, the more intensive the dimming. After each opening of the switch S3, the lamp 16 is re-ignited.

Figure 2:
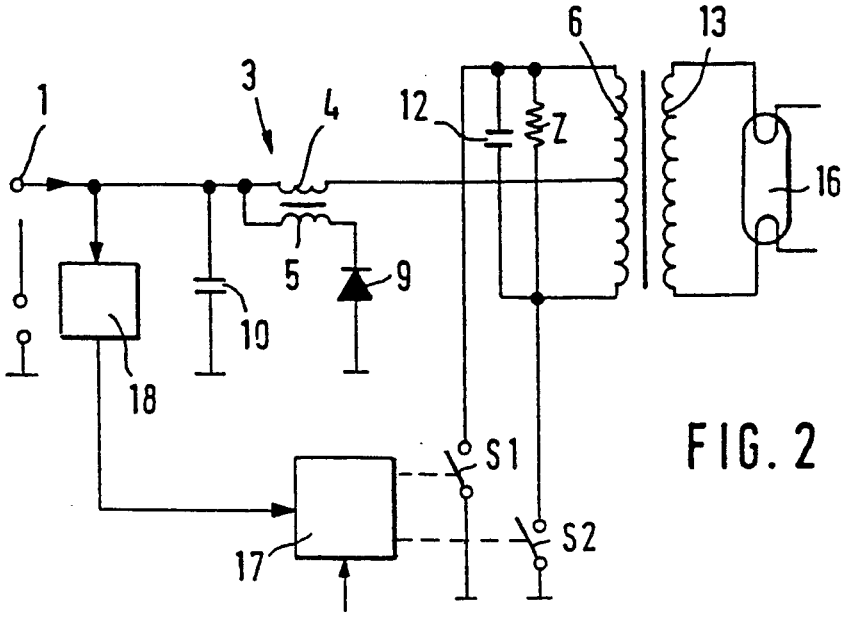
FIG. 2 illustrates an alternative embodiment of the block circuit diagram for frequency tuning.
Figure 3:
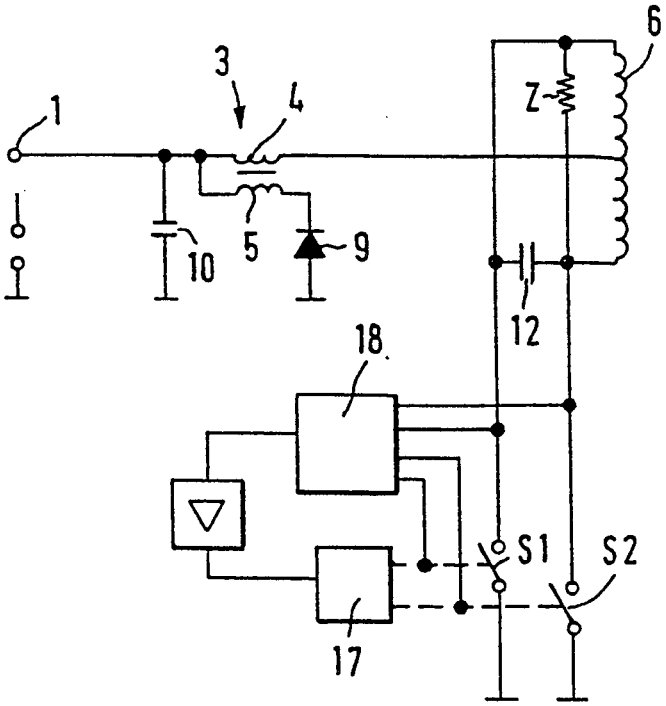
FIG. 3 illustrates a further alternative utilized for frequency tuning.

The exemplary embodiments pursuant to FIGS. 2 and 3 illustrate two possibilities for the adjustment of the pulse frequency of the pulse width modulator 17 to the resonant frequency of the oscillating circuit. In FIGS. 2 and 3 there is represented the oscillating circuit at the primary side from the primary winding 6 and the impedance of the gas discharge lamp 16 transformed by resonant capacitance 12 represented by "Z". In both exemplary embodiments there is ensured that the switches S1, S2 are controlled correctly in phase with the resonant frequency, so that this cannot lead to an inexpedient switching behavior of the switches S1, S2, which could result in an increase in output losses and a non-sinusoidal oscillation.

In the exemplary embodiment pursuant to FIG. 2, the control circuit 18 detects the input current in front of the transformer 3, and controls the pulse frequency of the pulse width modulator 17 which controls the switches S1, S2 in such a manner that there is obtained a localized current minimum for the input current.

In the exemplary embodiment pursuant to FIG. 3, use is made of the aspect that upon an activation of the push-pull oscillator 8 which is not correctly in phase, there is obtained a distorted oscillating form. In FIG. 6*a* there is represented the undistorted sinusoidal waveform, which is obtained when the switch S1, referring to FIG. 6*b*, and the switch S2, referring to FIG. 6*c*) are switched correctly in phase. The undistorted sinusoidal form is based on the aspect that the time periods T1 pursuant to FIG. 6*b* are equal to the time periods T2 pursuant to FIG. 6*c*, and also the time periods T3 pursuant to 6*b* are equal to the time periods T4 shown in FIG. 6*c*. FIG. 7 illustrates a distorted sinusoidal cycle. In this cycle, the time periods T1 and T2 are not equal with each other. Just as well are the time periods T3 and T4 not equal. In order to achieve equal time periods T1, T2 and, respectively, T3 and T4, the control circuit 18 pursuant to FIG. 3 measure time periods and, in conformance therewith, regulates the pulse frequency of the pulse width modulator 17 in such a manner that there is obtained a symmetrical control or actuation.

In the exemplary embodiment pursuant to FIG. 5 there is represented the series circuit of a plurality of gas discharge lamps. These are controllable through the secondary winding 13 of the push-pull oscillator 8. Connected in series with the switch S3 is a primary winding 32 of a heating transformer 33, whose secondary windings 34 presently heat two interconnected filaments 14 and, respectively, 15.

As an external heating, for lamps whose filaments must be continually heated, the heat output can be supplied from the output transformer 7, or from the transformer 3, or from the above-mentioned AC/DC-converter.

At power supply voltages which are high in comparison with the internal operating voltage of the electronic circuitry, it is recommended to make provision for an auxiliary power supply which is adjusted to the voltage requirement of the electronic circuitry. The power for the auxiliary power supply can be drawn from the output transformer 7, or from the transformer 3, or the mentioned AC/DC-converter.

I claim:

1. A power supply circuit for at least one power consuming lamp which is connected to a power supply, particularly for power consuming lamps such as at least one gas discharge lamp or glow lamp or flashlight lamp, comprising: a pulse width modulator; a push-pull oscillator having electronic switches controlled by said pulse width modulator, and further having a resonant output transformer, having a control winding, a primary winding, and a secondary winding, wherein a resonant capacitor is coupled to said primary winding of the output transformer, and said secondary winding of the resonant output transformer is connected to at least one power consuming lamp; said pulse width modulator having a pulse frequency which is tuned to the resonant frequency of the resonant output transformer of the push-pull oscillator; a control circuit means for monitoring the resonant frequency of the output transformer and responding to a changed resonant frequency by adjusting the pulse frequency of the pulse width modulator to the changed resonant frequency, said control circuit means monitoring the resonant frequency of the output transformer by monitoring at least one of, (i) deviations from a resonant voltage form through said control winding of the primary circuit of the output transformer, (ii) the input current to the power supply circuit, and (iii) time periods leading to distortions in the sinusoidal oscillations of the resonant frequency; and further wherein an input transformer is connected to the input of said primary winding of the output transformer, said input transformer having a first winding and a second winding, with said first winding of the input transformer being connected in series with said primary winding of the output transformer, and said second winding of the input transformer being connected with a diode and functioning as a free wheeling winding to the supply voltage.

2. A power supply circuit as claimed in claim 1, wherein the control circuit means for adjusting the pulse frequency of the pulse width modulator determines deviations from a resonant voltage form through a control winding of the primary circuit of or output transformer.

3. A power supply circuit as claimed in claim 2, wherein the control circuit means for varying the pulse frequency of the pulse width modulator also monitors the input current to the power supply circuit.

4. A power supply circuit as claimed in claim 3, wherein the control circuit means for adjusting the pulse frequency of the pulse width modulator also measures time periods leading to distortions in the sinusoidal oscillations of the resonant frequency.

5. A power supply circuit as claimed in claim 2, wherein the control circuit means for adjusting the pulse frequency of the pulse width modulator measures time periods leading to distortions in the sinusoidal oscillations of the resonant frequency.

6. A power supply circuit as claimed in claim 1, wherein the control circuit means for varying the pulse frequency of the pulse width modulator monitors the input current to the power supply circuit.

7. A power supply circuit as claim in claim 6, wherein the control circuit means for adjusting the pulse frequency of the pulse width modulator measures time periods leading to distortions in the sinusoidal oscillations of the resonant frequency.

8. A power supply circuit as claimed in claim 1, wherein the control circuit means controls the duty cycle of the pulse width modulator.

9. A power supply circuit as claimed in claim 8, wherein the control circuit means controls the keying ratio of the pulse width modulator independently of the fluctuating input voltage and/or for generating differing output currents.

10. A power supply circuit as claimed in claim 1, wherein the control means for adjusting the pulse frequency of the pulse width modulator measures time periods leading to distortions in the sinusoidal oscillations of the resonant frequency.

11. A power supply circuit as claimed in claim 1, wherein the control circuit means controls a switch for short-circuiting the filaments of the gas discharge lamp thereby adjusting the ratio of heating current and operating current.

12. A power supply circuit as claimed in claim 1, wherein a series circuit of a plurality of gas discharge lamps is connected in parallel with the secondary winding of the output transformer, said gas discharge lamps having filaments having at least one heating transformer operatively associated therewith.

13. A power supply circuit as claimed in claim 12, wherein a primary winding of the at least one heating transformer is connected in series with the switch.

* * * * *

UNITED STATES PATENT AND TRADEMARK OFFICE

CERTIFICATE OF CORRECTION

PATENT NO. : 5,298,836

DATED : March 29, 1994

INVENTOR(S) : Peter Backmund, et al.

Figure 6:
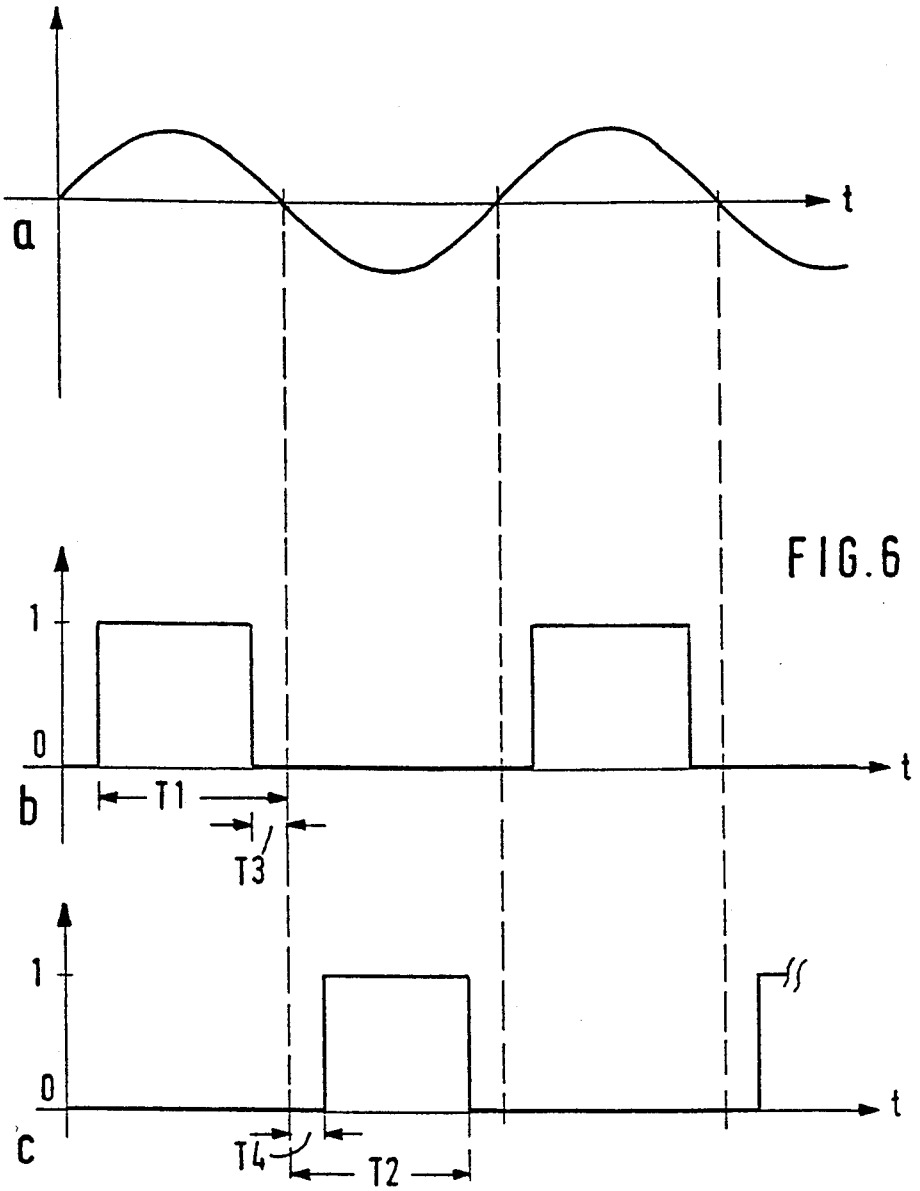
FIGS. 6(*–c*) and 7 each, respectively, illustrates switching time plots for the circuit shown in FIG. 3.
Figure 7:
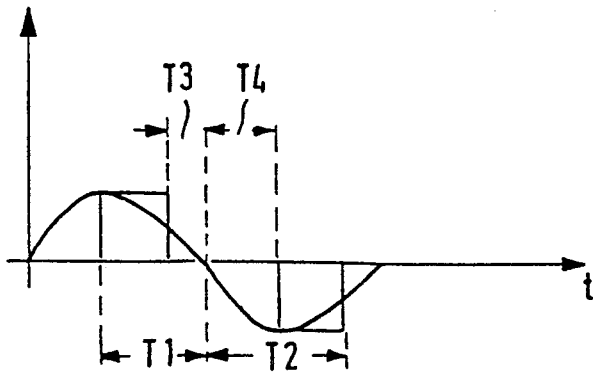

It is certified that error appears in the above-indentified patent and that said Letters Patent is hereby corrected as shown below:

Column 2, line 63: —FIGS. 6(a-c)— (See [C]3)

Column 7, line 28, Claim 7: "claim" should read --claimed-- (first occurrence)

Signed and Sealed this

Seventeenth Day of January, 1995

*Attest:*

*Attesting Officer*

BRUCE LEHMAN

*Commissioner of Patents and Trademarks*